United States Patent [19]

Gaumer, Jr. et al.

[11] Patent Number: 4,765,813

[45] Date of Patent: Aug. 23, 1988

[54] HYDROGEN LIQUEFACTION USING A DENSE FLUID EXPANDER AND NEON AS A PRECOOLANT REFRIGERANT

[75] Inventors: Lee S. Gaumer, Jr., Allentown; Arthur R. Winters, Jr., Coopersburg, both of Pa.

[73] Assignee: Air Products and Chemicals, Inc., Allentown, Pa.

[21] Appl. No.: 1,127

[22] Filed: Jan. 7, 1987

[51] Int. Cl.[4] ..... F25J 3/02

[52] U.S. Cl. ..... 62/20; 62/23; 62/39; 62/40

[58] Field of Search ..... 62/9, 11, 20, 22, 23, 62/36, 38, 39, 40, 41, 79, 514 R

[56] References Cited

U.S. PATENT DOCUMENTS

| | | | |
|---|---|---|---|
| 3,092,461 | 6/1963 | Vander Arend et al. | 62/20 X |
| 3,098,732 | 7/1963 | Dennis | 62/9 |
| 3,180,709 | 4/1965 | Yendall et al. | 23/210 |
| 3,473,342 | 10/1969 | Leyarovski et al. | 62/9 |
| 3,609,984 | 10/1971 | Garwin | 62/22 |
| 3,611,740 | 10/1971 | Giger | 62/79 |
| 3,613,387 | 10/1971 | Collins | 62/100 |
| 3,992,167 | 11/1976 | Beddome | 62/18 |
| 4,189,930 | 2/1980 | Davydov et al. | 62/502 |
| 4,242,875 | 1/1981 | Schaefer | 62/23 |
| 4,267,701 | 5/1981 | Toscano | 62/9 X |
| 4,346,563 | 8/1982 | Hood | 62/117 |
| 4,498,313 | 2/1985 | Hosoyama et al. | 62/514 R |

OTHER PUBLICATIONS

"A Plant for the Production of Liquid Hydrogen with Neon as an Intermediate Working Substance", K. Clusius, Kalte-Industrie 39, 1932.

"Hydrogen Liquefaction Using Centrifugal Compressors", C. R. Baker, Hydrogen Energy Progress, vol. 3, 1982.

*Primary Examiner*—Steven E. Warner

*Attorney, Agent, or Firm*—Willard Jones, II; James C. Simmons; William F. Marsh

[57] ABSTRACT

The present invention is a process for the liquefaction of hydrogen which utilizes a dense fluid expander and neon as a precoolant refrigerant. In the process, a two phase mixture containing about 85-90% liquid of greater than 95% para-hydrogen is produced in a dense fluid expander. Most of the refrigeration for liquefaction is supplied by a neon refrigeration system, consisting of a centrifugal compressor, heat exchangers and one or more stages of neon expansion. As an option, further refrigeration may be supplied utilizing liquid nitrogen as another precoolant.

6 Claims, 1 Drawing Sheet

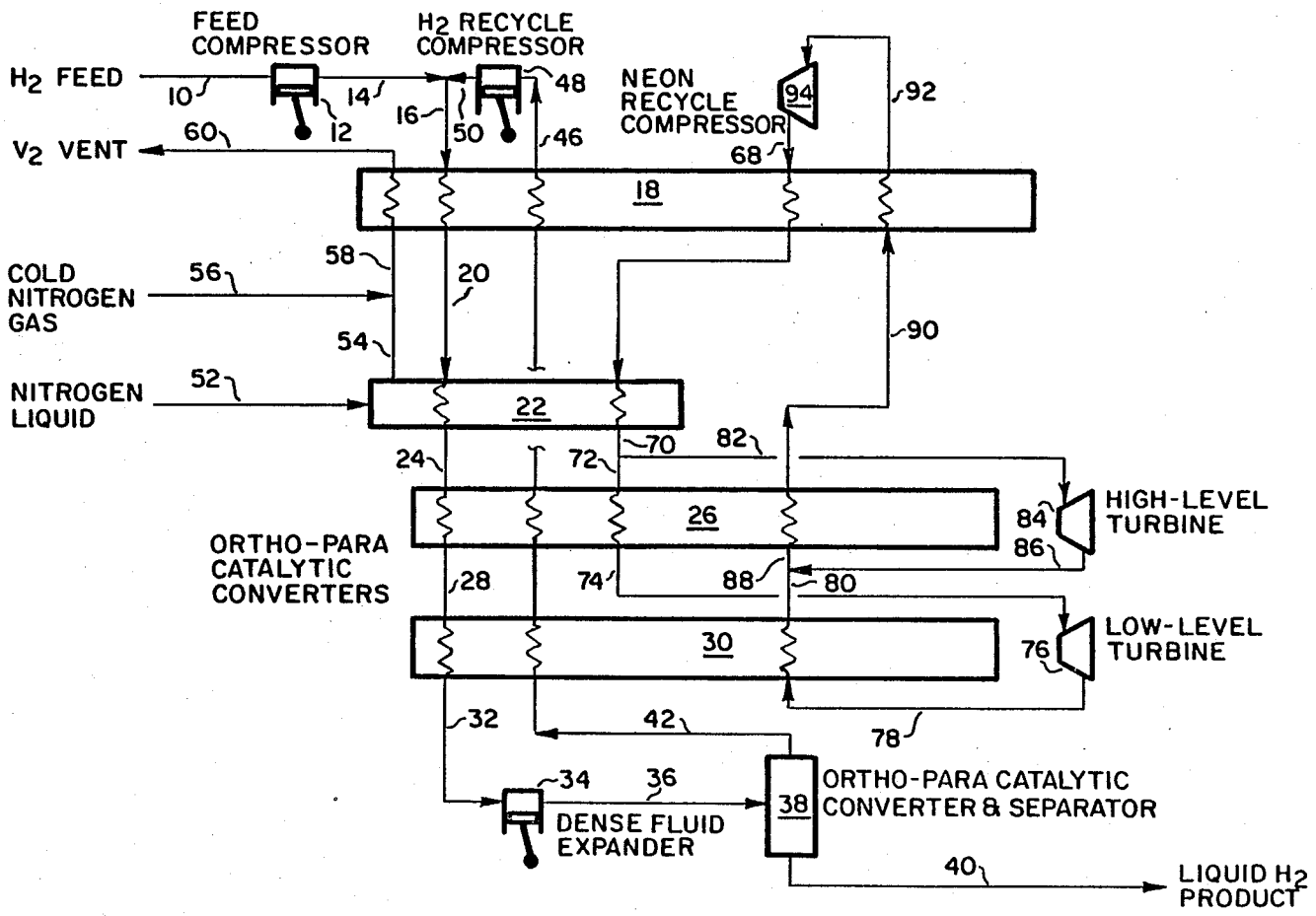
H2 FEED
FEED COMPRESSOR
H2 RECYCLE COMPRESSOR
NEON RECYCLE COMPRESSOR
V2 VENT
COLD NITROGEN GAS
NITROGEN LIQUID
ORTHO-PARA CATALYTIC CONVERTERS
HIGH-LEVEL TURBINE
LOW-LEVEL TURBINE
ORTHO-PARA CATALYTIC CONVERTER & SEPARATOR
DENSE FLUID EXPANDER
LIQUID H2 PRODUCT
10
12
14
16
18
20
22
24
26
28
30
32
34
36
38
40
42
46
48
50
52
54
56
58
60
68
70
72
74
76
78
80
82
84
86
88
90
92
94

HYDROGEN LIQUEFACTION USING A DENSE FLUID EXPANDER AND NEON AS A PRECOOLANT REFRIGERANT

The present invention was made under Air Force Contract No. FO-4611-85-C-4039 (AFRPL) and is subject to government rights arising therefrom.

TECHNICAL FIELD

The present invention relates to a process for the liquefaction of hydrogen.

BACKGROUND OF THE INVENTION

Several processes have been proposed or used commercially for the liquefaction of low molecular weight gases.

An article by K. Clusius, "A plant for the production of Liquid Hydrogen with Neon as an Intermediate Working Substance," *Zeitschrift for Die Gesamte Kalte-Industrie* 39, No. 6, 14-7 (1933), discloses a process for the liquefaction of hydrogen utilizing a high pressure Linde cycle using evacuated liquid air or liquid nitrogen as the precoolant and high pressure neon as an intermediate working fluid and six atmosphere hydrogen expansion for final refrigeration requirements. The article does not teach the use of expansion engine cycles such as are used in the Claude or Brayton cycles.

U.S. Pat. No. 3,180,709 discloses a process for the liquefaction of gases, e.g. hydrogen, helium and neon, using multiple isenthalpic expansions (J-T valves) in parallel combination with an expander.

U.S. Pat. No. 3,473,342 describes a process specifically to liquefy large quantities of neon by cooling compressed gaseous neon with liquid nitrogen, expanding a portion of the cooled compressed neon in a turbo-expander to provide intermediate refrigeration and expanding the remaining neon through J-T expansion to produce liquid neon. Basically, the cycle is a single engine Claude refrigerator.

U.S. Pat. 3,609,984 discloses a process for the liquefaction of gases such as hydrogen, helium and neon. Basically, the process achieves the liquefaction by compression of the gas to a pressure such that upon isobarically cooling the compressed gas, a temperature above the critical temperature of the gas is reached at which the gas can be isentropically expanded to yield substantially a single liquid phase at atmospheric pressure; then isobarically cooling the gas, followed by isentropically expanding the cooled gas through a work engine thereby producing a substantial liquid phase.

U S. Pat. No. 3,992,167 and an article by C. F. Baker, "Hydrogen Liquefaction Using Centrifugal Compressors", *Hydrogen Energy progress IV,* Volume 3, pargamon Press (1982) disclose a process for the liquefaction of hydrogen using a second component admixed with hydrogen in order to utilize centrifugal compression. Both references teach the need for higher molecular weight gases in order to utilize centrifugal compression.

U.S. Pat. No. 4,498,313 discloses a helium refrigeration process and apparatus which includes a neon gas-refrigerating and liquefying circuit which precools the helium gas and uses a turbine type compressor. The process also utilizes liquid nitrogen for additional refrigeration duty.

SUMMARY OF THE INVENTION

The present invention is an improvement to a process for the liquefaction of hydrogen, wherein a hydrogen stream is compressed, cooled and catalytically converted from a largely ortho form of hydrogen to a largely para form of hydrogen. This compressed, cooled, converted hydrogen stream is then expanded in an expander whereby said converted hydrogen stream is partially condensed. The partially condensed hydrogen stream is then separated into a liquid phase and gaseous phase; the gaseous phase is warmed to recover refrigeration, compressed and combined with said compressed hydrogen stream prior to conversion; the liquid phase is withdrawn as a liquid hydrogen product. The improvement to the hydrogen liquefaction process comprises utilizing a dense fluid expander to expand the converted hydrogen stream and utilizing a closed-loop neon refrigeration cycle to provide intermediate refrigeration for the liquefaction process.

As an option, additional refrigeration for cooling the compressed hydrogen stream or for precooling the neon in the closed-loop refrigeration cycle can be provided with liquid nitrogen.

BRIEF DESCRIPTION OF THE DRAWINGS

The single figure of the drawing is a schematic representation of a single embodiment of the hydrogen liquefaction process of the present invention.

DETAILED DESCRIPTION OF THE INVENTION

Large scale liquefaction and refrigeration plants for the two cryogens, hydrogen and helium, require large scale compression systems. These systems, because of the low molecular weight of these cryogens, i.e. 2 and 4, respectively, must use positive displacement type compressors and expanders.

With the growth in the projected need for liquid hydrogen, especially for propellant use, comes the need for large scale hydrogen production; the units to accomplish this large scale hydrogen production may be two to three times larger than existing commercial systems. In order to increase the effectiveness of these expanded requirements, it will be desirable to have systems that are readily transportable from one location to another with minimal reconstruction. These desired characteristics of size and ease of transport mandate the development of a hydrogen liquefaction system which uses centrifugal compressors and expanders.

Existing hydrogen liquefiers use positive displacement compressors. There are three principal types of compressors that have been used or proposed for large scale hydrogen and helium systems; these are: (a) Roots-type lobe blowers, (b) Lysholm-type axial screw compressors, and (c) reciprocating piston compressors. There are several variations of each, mainly whether the gas being compressed is or is not in direct contact with a liquid, usually oil, which serves as a lubricant or as a combination lubricant and coolant.

The Roots-type compressors have been used principally in applications where there is only subatmospheric suction pressures for helium. These type compressors are limited to modest compression ratios per stage, i.e. 1.4 to 2.0, and by relatively low maximum casing pressures, i.e. approximately 200 psig.

Lysholm oil flooded screw compressors, which are used extensively for helium systems, are inherently limited to pressures in the range of 300 psig. They do have the advantage of having high compression ratios per stage, i.e. up to 6, because of the cooling effect of the large mass of oil that is recirculated through the machine and then exchanged against cooling water. The compressor is less energy efficient but is less prone to gas leakage.

Reciprocating compressors are used on many helium systems and essentially all hydrogen systems, principally because of the higher operating pressures, e.g. 1200 psig, of hydrogen liquefiers. With recent advances, the energy efficiency of the reciprocating compressor has been improved. Unfortunately, because of the unbalanced reciprocating forces involved, these compressors must be installed on large foundations.

Neither large scale screw type or reciprocating compressors are compact. While screw compressors are usually skid mounted, they are, on the other hand, limited to approximately 2250 hp per machine. Large installations would require multiple parallel machines at each stage.

The solution to the above problem of size is the use of centrifugal compressors, however, centrifugal compression is unsuitable for low molecular weight gas such as hydrogen or helium.

The present invention is a hydrogen liquefaction process which, in part, uses neon as a precoolant refrigerant. Neon is recycled through a suitable centrifugal or axial flow compressor from a suction pressure near atmospheric pressure, e.g. 16 psia. The pressure can be no lower than the 6.27 psia vapor pressure at the triple point of neon but can be at a higher pressure consistent with good overall thermodynamic efficiency and neon conservation. The neon is refrigerated by expansion through one or more radial-inflow turbo-expanders. Alternatively, the neon can be precooled with another cryogen, e.g. boiling liquid nitrogen, liquid carbon dioxide, etc, for increased efficiency.

The neon leaving the coldest expander can be either a cold gas or a two phase mixture. It can also form a two phase mixture by expansion across a Joule-Thomson valve, with or without recuperative heat exchange between the outlet of the coldest turbo-expander and the expansion valve. It should be noted that the use of reciprocating expanders is not precluded, but capacity, reliability and compactness make turbo-expanders preferable.

As for the remainder of the process of the present invention, purified hydrogen is suitably compressed to a pressure in excess of the critical pressure of 188 psia, precooled in multiple-pass heat exchangers principally by low pressure recycling neon gas and also by low pressure recycled hydrogen gas. Additionally, the hydrogen gas can be precooled by liquid nitrogen or by other liquefied gases that are used as a precoolant for neon.

Means are provided for the catalytic shift of the form of hydrogen from its normal composition of 75 percent ortho and 25 percent para to a composition greater than 95 percent para when liquefied. This conversion from largely ortho hydrogen to largely para hydrogen is necessary to maintain the liquefied hydrogen as a liquid when stored.

The final stage of refrigeration utilizes a dense fluid hydrogen expander, which operates at inlet conditions and expansion efficiencies so as to produce a product which is 85 to 90 molar percent liquid hydrogen. This two phase mixture goes to a phase separator; the separated liquid fraction goes to storage, while the saturated vapor fraction is recycled through recuperative heat exchange to ambient temperature for recompression. Additionally, the feed can be further increased in para-hydrogen concentration by a liquid phase converter. The converted liquid (ortho to para) can be further cooled by flashing some of the liquid phase across a J-T valve to provide coolant in a product subcooler.

As can be seen from the above description, the present invention has two complementary elements—the use of neon as an intermediate refrigerant and the use of a dense fluid expander for hydrogen.

The use of neon as the intermediate refrigerant is practical because of the thermodynamic properties of neon. Neon has an atomic weight of 20, a normal boiling point of −410.4° F. (27.2 K, −248.9° C.) and a critical temperature of −379.7° F. (44.1 K, −229° C.) at a critical pressure of 395 psia (2,723 kPa). It is the only substance which exists in the liquid phase between the triple points of the various hydrogen isotopes and oxygen, −361.8° F. (54.0 K, −219.1° C.), fluorine, −363.3° F. (53.2 K, −219.9° C.) or $OF_2$, −370° F. (49.4 K, −223.7° C.). Since the triple point vapor pressures of oxygen, fluorine or $OF_2$ are on the order of 0.01 psia (68.9 Pa), they cannot be considered as representing a practical temperature limit. Also, chemically these substances are disastrously reactive with hydrogen. Neon is comparable to steam, which has a molecular weight of 18, and hence is quite capable of being compressed to any compression ratio in a reasonable number of stages. Neon is one of the noble gases and is inert, nonflammable and nontoxic.

The use of a dense fluid expander results in a reduction in energy consumption per unit of product liquid hydrogen.

To better describe the interaction of these complementary elements, the following description of a preferred embodiment is offered. With reference to the single figure of the drawing, a gaseous hydrogen feed is fed via line 10 to and compressed in reciprocating compressor 12. The compressed hydrogen feed in line 14 is combined with the compressed recycle hydrogen stream in line 50 forming a combined hydrogen stream in line 16. This combined hydrogen stream in line 16 is then heat exchanged against warming process streams in heat exchanger 18 resulting in the cooled combined hydrogen stream in line 20. This cooled combined hydrogen stream in line 20 is further cooled in heat exchanger 22 to a temperature approaching that of liquid nitrogen. The further cooled combined hydrogen stream in line 24 is fed to first ortho-para catalytic converter 26, wherein a portion of the ortho form of hydrogen is converted to the para form. Converter 26 also acts as a heat exchanger further cooling the combined hydrogen stream. The resultant product from first ortho-para converter 26 in line 28 is fed to second ortho-para catalytic converter 30 for further conversion from the ortho form to the para form and for further cooling. Overall, ortho-para converters 26 and 28, convert the combined hydrogen stream from a composition of approximately 75/25 molar percent ortho/para to approximately 5/95 molar percent ortho/para. The converted hydrogen stream in line 32 is then expanded in dense fluid expander 34 resulting in a two phase hydrogen stream. This two phase hydrogen stream in line 36 is fed to converter-separator 38. Converter-separator 38 serves a dual purpose, one to separate two phase stream 36 into a liquid phase and gaseous phase and to further convert the para concentration of the liquid phase hydrogen to greater than 98%. In further converting the liquid hydrogen from ortho to para-hydrogen, a portion of the liquid phase will be vaporized. The further converted liquid portion from converter-separator 38 is removed via line 40 as liquid hydrogen product. The gaseous portion from converter-separator 38, which includes the gaseous hydrogen produced due to the conversion of the liquid, is recycled via line 42 through converters 30 and 26 to recover any refrigeration value. The warmed recycle stream in line 46 is compressed in reciprocating compressor 48 resulting in compressed recycle hydrogen stream 50. The heat exchange for the hydrogen liquefaction cycle is provided by recovering the refrigeration value from recycle hydrogen stream 42, a closed neon refrigeration loop, and, optionally, vaporizing liquid nitrogen followed by superheating gaseous nitrogen.

The closed neon refrigeration loop interacts with the hydrogen liquefaction process in heat exchangers 18 and 22 and converters 26 and 30. In the closed loop, a compressed neon stream in line 68 is cooled against warming process streams in heat exchangers 18 and 22. This cooled compressed neon stream in line 70 is then split into a first and second portion. The first portion in line 72 is further cooled by heat exchange with warming process streams in converter 26. The cooled first portion in line 74 is then expanded in turbine 76 resulting in a further cooled first portion in line 78. This further cooled first portion in line 78 is warmed in converter 30 thereby providing refrigeration to the process. The second portion in line 82 is expanded in turbine 84 resulting in a cooled second portion in line 86. This cooled second portion in line 86 and the warmed first portion in line 80 are combined into a recycle neon stream in line 88 and warmed in converter 26 thereby providing refrigeration to the process. The recycle neon stream is further warmed in heat exchanger 18 to recover any remaining refrigeration value and is fed to neon refrigeration loop compressor 94 via line 92.

As an optional, additional source of refrigeration duty, liquid nitrogen and/or cold gaseous nitrogen can be heat exchanged with the liquefaction process. In doing such, liquid nitrogen in line 52 would be fed to and warmed in heat exchanger 22 resulting in at least a partially vaporized nitrogen stream in line 54. This at least partially vaporized nitrogen stream in line 54 can be combined with cold nitrogen gas in line 56 and fed to heat exchanger 18 via line 58. The nitrogen stream in line 58 is warmed in heat exchanger 18 to recover any remaining refrigeration value and is then vented to the atmosphere via line 60.

To demonstrate the benefits of the present invention and to provide a comparison with nearest prior art references, the following results from computer simulations are provided.

EXAMPLE 1

With reference to the present invention as depicted in the single figure of the drawing, a gaseous hydrogen feed, with 25 mol % being the para isotope and 75 mol % being the ortho isotope, is fed, via line 10, and is compressed to 650 psia (4,480 kPa) in reciprocating compressor 12. The compressed hydrogen feed in line 14 is combined with the compressed recycle hydrogen stream in line 50 forming a combined hydrogen stream in line 16 of which 15 vol % represents recycled hydrogen. This combined hydrogen stream in line 16 is then cooled to −290° F. (−179° C.) in heat exchanger 18 resulting in the cooled combined hydrogen stream in line 20 which is further cooled in heat exchanger 22 to −310° F. (−190° C.). The further cooled combined hydrogen stream in line 24 is fed to first ortho-para catalytic converter 26, wherein a portion of the ortho form of hydrogen is converted to the para form. Converter 26 also acts as a heat exchanger further cooling the combined hydrogen stream. The resultant product from first ortho-para converter 26 in line 28 is fed to second ortho-para catalytic converter 30 for further conversion from the ortho form to the para form and for further cooling. Overall, ortho-para converters 26 and 28, convert the combined hydrogen stream from a composition of approximately 64/36 molar percent ortho/para to approximately 5/95 molar percent ortho/para and reduce its temperature to −404° F. (−242° C.). The converted hydrogen stream in line 32 is then expanded in dense fluid expander 34 resulting in a two phase hydrogen stream of which 90 wt % is liquid. This two phase hydrogen stream in line 36 is fed to separator 38. The liquid is removed via line 40 as liquid hydrogen product. It is important to note that although 90 wt % liquid is achieved from the dense fluid expander, a portion of the liquid will revaporize due to among other causes, the energy of the ortho hydrogen and heat leak, so that the final liquid yield will be about 85 wt %. The gaseous portion of stream 36 is recycled via line 42 through converters 30 and 26 to recover any refrigeration value. The warmed recycle stream in line 46 is compressed in reciprocating compressor 48 to 650 psia (4,480 kPa) resulting in compressed recycle hydrogen stream 50. The heat exchange for the hydrogen liquefaction cycle is provided by recovering the refrigeration value from recycle hydrogen stream 42, a closed neon refrigeration loop and warming liquid nitrogen.

The closed neon refrigeration loop interacts with the hydrogen liquefaction process in heat exchangers 18 and 22 and converters 26 and 30. In the closed loop, a compressed neon stream at a pressure of 150 psia (1,034 kPa) in line 68 is cooled to −310° F. (−190° C.) in heat exchangers 18 and 22. This cooled compressed neon stream in line 70 is then split into a first and second portion. The first portion, approximately 58 vol % of the total neon stream, in line 72 is further cooled to −366.5° F. (−221° C.) in converter 26. The cooled first portion in line 74 is then expanded in turbine 76 resulting in a further cooled first portion at a temperature of −408.3° F. (−245° C.) in line 78. This further cooled first portion in line 78 is warmed to −376.5° F. (−227° C.) in converter 30 thereby providing refrigeration to the process. The second portion, approximately 42 vol % of the total neon stream, in line 82 is expanded in turbine 84 resulting in a cooled second portion at a temperature of −376.5° F. (−227° C.) in line 86. This cooled second portion in line 86 and the warmed first portion in line 80 are combined into a recycle neon stream in line 88 and warmed to −320° F. (−196° C.) in converter 26 thereby providing refrigeration to the process. The recycle neon stream is further warmed to 100° F. (38° C.) in heat exchanger 18 to recover any remaining refrigeration value and is fed to the neon refrigeration loop compressor 94 via line 92.

As an additional source of refrigeration duty, liquid nitrogen and/or cold gaseous nitrogen is heat exchanged with the liquefaction process. In doing such, liquid nitrogen in line 52 would be fed to and warmed in heat exchanger 22 resulting in at least a partially vaporized nitrogen stream in line 54. This at least partially vaporized nitrogen stream in line 54 can be combined with cold saturated nitrogen gas in line 56 and fed to heat exchanger 18 via line 58. The nitrogen stream in line 58 is warmed in heat exchanger 18 to recover any remaining refrigeration value and is then vented to the atmosphere via line 60.

The power required to produce 36 tons/day of liquid hydrogen utilizing the process of the present invention is 12,974 KW, not including the power requirements for providing the liquefied and gaseous nitrogen. A material balance noting selected streams for the process is shown in Table 1.

TABLE I

MATERIAL BALANCE
NEON REFRIGERANT WITH DENSE FLUID EXPANSION 36 TONS/DAY ρ-HYDROGEN PRODUCTION

| Stream No. | Temperature °F. (°C.) | Pressure psia (kPa) | Flow lb moles/hr. | Phase | Composition |
|---|---|---|---|---|---|
| 10 | 90 (32) | 265 (1830) | 1502 | V | n-$H_2$ |
| 14 | 110 (43) | 650 (4485) | 1502 | V | n-$H_2$ |
| 16 | 110 (43) | 650 (4485) | 1773 | V | Mixed $H_2$ |
| 20 | −290 (−179) | 638 (4399) | 1773 | V | Mixed $H_2$ |
| 24 | −310 (−191) | 625 (4309) | 1773 | V | ε-$H_2$ |
| 28 | −367 (−222) | 613 (4226) | 1773 | V | ε-$H_2$ |
| 32 | −404 (−242) | 600 (4140) | 1773 | V | ρ-$H_2$ |
| 36 | −414 (−248) | 52 (360) | 1773 | L & V | ρ-$H_2$ |
| 40 | −414 (−248) | 52 (360) | 1502 | L | ρ-$H_2$ |
| 42 | −414 (−248) | 52 (360) | 271 | V | ρ-$H_2$ |
| 46 | 100 (38) | 46 (317) | 271 | V | ρ-$H_2$ |
| 50 | 110 (43) | 650 (4485) | 271 | V | ρ-$H_2$ |
| 52 | −316 (−194) | 20 (138) | 505 | L | Nitrogen |
| 54 | −318 (−195) | 17 (117) | 505 | V | Nitrogen |
| 56 | −318 (−195) | 17 (117) | 601 | V | Nitrogen |
| 58 | −318 (−195) | 17 (117) | 1106 | V | Nitrogen |
| 60 | 100 (38) | 15 (104) | 1106 | V | Nitrogen |
| 68 | 110 (43) | 150 (1034) | 8430 | V | Neon |
| 70 | −310 (−191) | 120 (827) | 8430 | V | Neon |
| 72 | −310 (−191) | 137 (945) | 4850 | V | Neon |
| 74 | −367 (−222) | 127 (876) | 4850 | V | Neon |
| 78 | −408 (−244) | 20 (138) | 4850 | V | Neon |
| 80 | −377 (−228) | 19 (131) | 4850 | V | Neon |
| 82 | −310 (−191) | 137 (945) | 3581 | V | Neon |
| 86 | −377 (−228) | 19 (131) | 3581 | V | Neon |
| 88 | −377 (−228) | 19 (131) | 8431 | V | Neon |
| 90 | −320 (−196) | 18 (125) | 8431 | V | Neon |
| 92 | 100 (38) | 16 (110) | 8431 | V | Neon |

NOTES:
n-$H_2$ = Normal Hydrogen
ε-$H_2$ = Equilibrium Hydrogen
ρ-$H_2$ = Para Hydrogen
P = Liquid
V = Vapor

EXAMPLE 2

The process as depicted in the single figure of the drawing was duplicated except the dense fluid expander was replaced with a Joule-Thomson valve, resulting in a process similar to that described in the Hosoyama patent, U.S. Pat. No. 4,498,313. The process with the inclusion of the J-T valve in place of the dense fluid expander, results in a liquid production from the J-T valve of approximately 76 wt %. The energy requirement to produce 36 tons/day of liquid hydrogen is 14,674 KW. A material balance noting selected streams for the Example 2 process is shown in Table 11.

TABLE II

MATERIAL BALANCE
NEON REFRIGERANT WITH JOULE-THOMSON EXPANSION 36 TONS/DAY ρ-HYDROGEN PRODUCTION

| Stream No. | Temperature °F. (°C.) | Pressure psia (kPa) | Flow lb moles/hr. | Phase | Composition |
|---|---|---|---|---|---|
| 10 | 90 (32) | 265 (1830) | 1502 | V | n-$H_2$ |
| 14 | 110 (43) | 650 (4485) | 1502 | V | n-$H_2$ |
| 16 | 110 (43) | 650 (4485) | 2114 | V | Mixed $H_2$ |
| 20 | −290 (−179) | 638 (4399) | 2114 | V | Mixed $H_2$ |
| 24 | −310 (−191) | 625 (4309) | 2114 | V | ε-$H_2$ |
| 28 | −367 (−222) | 613 (4226) | 2114 | V | ε-$H_2$ |
| 32 | −404 (−242) | 600 (4140) | 2114 | V | ρ-$H_2$ |
| 36 | −414 (−248) | 52 (360) | 2114 | L & V | ρ-$H_2$ |
| 40 | −414 (−248) | 52 (360) | 1502 | L | ρ-$H_2$ |
| 42 | −414 (−248) | 52 (360) | 612 | V | ρ-$H_2$ |
| 46 | 100 (38) | 46 (317) | 612 | V | ρ-$H_2$ |
| 50 | 110 (43) | 650 (4485) | 612 | V | ρ-$H_2$ |
| 52 | −316 (−194) | 20 (138) | 520 | L | Nitrogen |
| 54 | −318 (−195) | 17 (117) | 520 | V | Nitrogen |
| 56 | −318 (−195) | 17 (117) | 557 | V | Nitrogen |
| 58 | −318 (−195) | 17 (117) | 1077 | V | Nitrogen |
| 60 | 100 (38) | 15 (104) | 1077 | V | Nitrogen |
| 68 | 110 (43) | 150 (1034) | 9338 | V | Neon |
| 70 | −310 (−191) | 120 (827) | 9338 | V | Neon |
| 72 | −310 (−191) | 137 (945) | 5401 | V | Neon |
| 74 | −367 (−222) | 127 (876) | 5401 | V | Neon |
| 78 | −408 (−244) | 20 (138) | 5401 | V | Neon |
| 80 | −377 (−228) | 19 (131) | 5401 | V | Neon |
| 82 | −310 (−191) | 137 (945) | 3937 | V | Neon |
| 86 | −377 (−228) | 19 (131) | 3937 | V | Neon |
| 88 | −377 (−228) | 19 (131) | 9338 | V | Neon |
| 90 | −320 (−196) | 18 (125) | 9338 | V | Neon |
| 92 | 100 (38) | 16 (110) | 9338 | V | Neon |

NOTES:
n-$H_2$ = Normal Hydrogen
ε-$H_2$ = Equilibrium Hydrogen
ρ-$H_2$ = Para Hydrogen
P = Liquid
V = Vapor Comparing the results of Example 1, the present invention, and Example 2, the closest prior art, it is apparent that although both processes can achieve a production of hydrogen of 36 tons/day, there is a significant power requirement difference between the two processes. The process of the present invention represents an energy saving of about 13% over the process described in Example 2. A 2-3% decrease in the power requirement for the liquefaction of cryogens is considered significant. Additionally, the use of a dense fluid expander in the present invention results in a 10.8% reduction in the neon inventory required for the process as in Example 2.

The present invention has been described with reference to a preferred embodiment thereof. However, this embodiment should not be considered a limitation on the scope of the invention, which scope should be ascertained by the following claims.

We claim:

1. In a process for liquefying hydrogen wherein a hydrogen stream is compressed, cooled, and catalytically converted in a multiplicity of steps from a largely ortho form of hydrogen to a largely para form of hydrogen, said converted, cooled, compressed hydrogen stream is expanded in an expander whereby said converted hydrogen stream is partially condensed, said patially condensed hydrogen stream is separated into a liquid phase and gaseous phase, said gaseous phase is warmed to recover refrigeration and recompressed and combined with said compressed hydrogen stream prior to cooling, and said liquid phase is withdrawn as a liquid hydrogen product, the improvement comprising utilizing a dense fluid expander preceding said step of catalytic conversion to expand and further refrigerate said converted, cooled, compressed hydrogen stream and utilizing a closed-loop neon refrigeration cycle to provide at least intermediate refrigeration to said process prior to said final step of catalytic conversion.

2. The process of claim 1 which further comprises providing additional refrigeration for cooling of said compressed hydrogen stream.

3. The process of claim 1 which further comprises providing additional refrigeration for precooling neon in said closed-loop neon refrigeration cycle.

4. The process of claim 1 which further comprises providing additional refrigeration for cooling of said compressed hydrogen stream and for precooling neon in said closed-loop neon refrigeration cycle.

5. A process for the liquefaction of hydrogen which comprises:

(a) compressing and cooling a gaseous hydrogen feed stream;

(b) combining said compressed hydrogen feed stream with a compressed, recycled hydrogen stream from step (g) to form a combined hydrogen feed stream ;

(c) cooling said combined hydrogen feed stream by heat exchange with the warming recycled hydrogen stream and a closed loop neon refrigeration cycle;

(d) converting said cooled, combined hydrogen feed stream in two stages in a first and second converter/heat exchanger from a largely ortho form of hydrogen to a largely para form of hydrogen while simultaneously further cooling said combined hydrogen feed stream by heat exchange with the closed-loop neon refrigeration cycle and the warming recycled hydrogen stream;

(e) expanding the converted, combined hydrogen feed stream in a dense fluid expander whereby the converted, combined hydrogen feed stream is partially condensed;

(f) separating said partially condensed hydrogen feed stream of step (e) into a gaseous phase and liquid phase wherein said gaseous phase is used to form a recycle hydrogen stream and said liquid phase is further converted to increase para-hydrogen concentration and removed as a liquid hydrogen product stream;

(g) warming said recycle hydrogen stream to recover refrigeration and then compressing said recycle hydrogen stream prior to combining said recycle hydrogen stream with said compressed hydrogen feed stream in step (b);

(h) compressing and precooling a closed-loop neon refrigeration stream;

(i) splitting said closed-loop neon refrigeration stream into a first portion and a second portion;

(j) further cooling said first portion and then expanding said cooled first portion in a turbine;

(k) warming said first portion from step (j) in said second converter/heat exchanger thereby providing refrigeration;

(l) expanding said second portion in an expander and combining said expanded second portion with said warmed first portion from step (k) into a recombined closed-loop neon refrigeration stream;

(m) warming said recombined closed-loop refrigeration stream in said first converter/heat exchanger thereby providing refrigeration;

(n) further warming said recombined closed-loop neon refrigeration stream to recover refrigeration value; and (o) recycling said recombined closed-loop neon refrigeration stream to step (h) as said closed-loop neon refrigeration stream.

6. The process of claim 5 which further comprises providing refrigeration for said cooling in step (c) and said precooling in step (h) with liquid and cold gaseous nitrogen.

* * * * *

UNITED STATES PATENT AND TRADEMARK OFFICE

CERTIFICATE OF CORRECTION

PATENT NO. : 4,765,813

DATED : Aug. 23, 1988

INVENTOR(S) : Lee S. Gaumer, Jr., et al.

It is certified that error appears in the above-identified patent and that said Letters Patent is hereby corrected as shown below:

Column 9, Line 1
After "said", insert -- final --

Signed and Sealed this

Fourteenth Day of February, 1989

*Attest:*

DONALD J. QUIGG

*Attesting Officer*

*Commissioner of Patents and Trademarks*